US005356357A

United States Patent [19]

Wang et al.

[11] Patent Number: 5,356,357

[45] Date of Patent: Oct. 18, 1994

[54] RIDING EXERCISER

[75] Inventors: Leao Wang; Peter Wu, both of Taichung Hsien, Taiwan

[73] Assignee: Greenmaster Industrial Corp., Taiping Hsiang, Taiwan

[21] Appl. No.: 199,887

[22] Filed: Feb. 24, 1994

[51] Int. Cl.[5] ..... A63B 21/00; A63B 69/06

[52] U.S. Cl. ..... 482/96; 482/72; 482/57

[58] Field of Search ..... 482/72, 96, 95, 112, 482/58, 57, 62, 73, 51

[56] References Cited

U.S. PATENT DOCUMENTS

| | | | |
|---|---|---|---|
| 2,470,544 | 5/1949 | Bell | 482/96 |
| 4,743,010 | 5/1988 | Geraci | 482/72 |
| 5,139,255 | 8/1992 | Sollami | 482/58 |
| 5,299,997 | 4/1994 | Chen | 482/72 |

FOREIGN PATENT DOCUMENTS

| | | | |
|---|---|---|---|
| 0495304 | 8/1953 | Canada | 482/96 |

*Primary Examiner*—Stephen R. Crow
*Attorney, Agent, or Firm*—Bacon & Thomas

[57] ABSTRACT

A riding exerciser includes two curved base frames, two parallel seat supports pivoted to the curved base frame in the middle to support a seat, a lower actuating rod having a top end pivotally connected between the curved base frames at the top and a bottom end fixed with a U-tube to hold a pair of pedals, an upper actuating rod pivoted to the lower actuating rod to hold a handle, and a link connected between the lower actuating rod and the seat supports, wherein the upper actuating rod has a series of lock holes on a bottom sector plate thereof for locking in any of a series of angular positions by a spring-supported lock bolt on the lower actuating rod; the lower actuating rod has a horizontal socket with a radial slot at the top, through which a headed screw is inserted and threaded into a screw hole on the handle to limit the rotating angle of the handle relative to the horizontal socket.

2 Claims, 7 Drawing Sheets

RIDING EXERCISER

BACKGROUND OF THE INVENTION

The present invention relates to gymnastic machines, and relates more particularly to a riding exerciser.

Various riding exercisers have been disclosed, and have appeared on the market. FIG. 1 shows a riding exerciser according to the prior art which is generally comprised of a bridge-like base frame 1, a seat 2 mounted on the base frame 1 in the middle at the top, a pair of actuating rods 3 pivotally and bilaterally fastened to the base frame 1 at the front, each actuating rod 3 having a top end terminating in a hand grip 4 and a bottom end terminating in a pedal 5, and two hydraulic cylinders 6 respectively connected between the base frame 1 and either actuating rod 3 to give damping force. This structure of riding exerciser is not satisfactory in function because the hydraulic cylinders 6 provide limited damping force and short service life.

FIG. 2 shows another structure of riding exerciser according to the prior art which is generally comprised of a flat base frame 11, a pedal support 12 pivotally fastened to the base frame 11 by a pivot A to support two pedals 17, a pair of seat supports 13 obliquely raised from the base frame 11 to support a seat 15, a handle support 14 pivotally fastened between the seat supports 13 by a pivot B and coupled with a horizontal handlebar 16 at the top, and a link 18 connected between the pedal support 12 and the handle support 14. When in use, the player sits on the seat 15 with the hands pulling the handlebars 16 and the legs stepping on the pedals 17, and therefore the seat 14 is moved up and down alternatively. During the operation of the riding exerciser, damping force comes from the body weight of the user. This structure of riding exerciser achieves certain effect in exercises, however the user will feel uncomfortable during exercising. Before moving the handlebar 16 and the pedals 17, the player sits on the seat 15 straight up. When the pedals 17 are moved to the lowest position, the seat 15 is moved to the highest position, and the handlebars 16 become stopped at the player's upper abdomen. To a fat player, the handlebars 16 will compress the upper abdomen, when the seat 15 is moved to the highest position, causing the player feel uncomfortable. Therefore, the player may quickly move the handlebars 16 back before they reach the upper limit, i.e., the player does not fully exercise oneself on the riding exerciser. Another drawback of this structure of riding exerciser is that the apparatus allows the player only to repeatedly extend out the hands and then to move them back without exercising the muscles of the chest. Still another drawback of this riding exerciser is that the pivot B and the pulley at the bottom of the handle support 14 tend to be damaged easily because they directly bear the pressure of the player.

SUMMARY OF THE INVENTION

The present invention has been accomplished to provide a riding exerciser which eliminates the aforesaid drawbacks.

According to one aspect of the present invention, the riding exerciser comprises two curved base frames, two parallel seat supports pivoted to the curved base frame in the middle to support a seat, a lower actuating rod having a top end pivotally connected between the curved base frames at the top and a bottom end fixed with a U-tube to hold a pair of pedals, an upper actuating rod pivoted to the lower actuating rod to hold a handle, and a link connected between the lower actuating rod and the seat supports, wherein the upper actuating rod has a series of lock holes on a bottom sector plate thereof for locking in any of a series of angular positions by a spring-supported lock bolt on the lower actuating rod, and therefore the amount of exercise can be adjusted according to individual's physical conditions.

According to another aspect of the present invention, the lower actuating rod has a horizontal socket with a radial slot at the top, through which a headed screw is inserted and threaded into a screw hole on the handle to limit the rotating angle of the handle relative to the horizontal socket.

According to still another aspect of the present invention, the seat is pivoted to the seat supports, and therefore it is constantly maintained in horizontal during the operation of the riding exerciser.

According to still another aspect of the present invention, the handle is made of curved shape so that it does not touch the body of the user during the operation of the riding exerciser.

DETAILED DESCRIPTION OF THE PREFERRED EMBODIMENT

Figure 1:
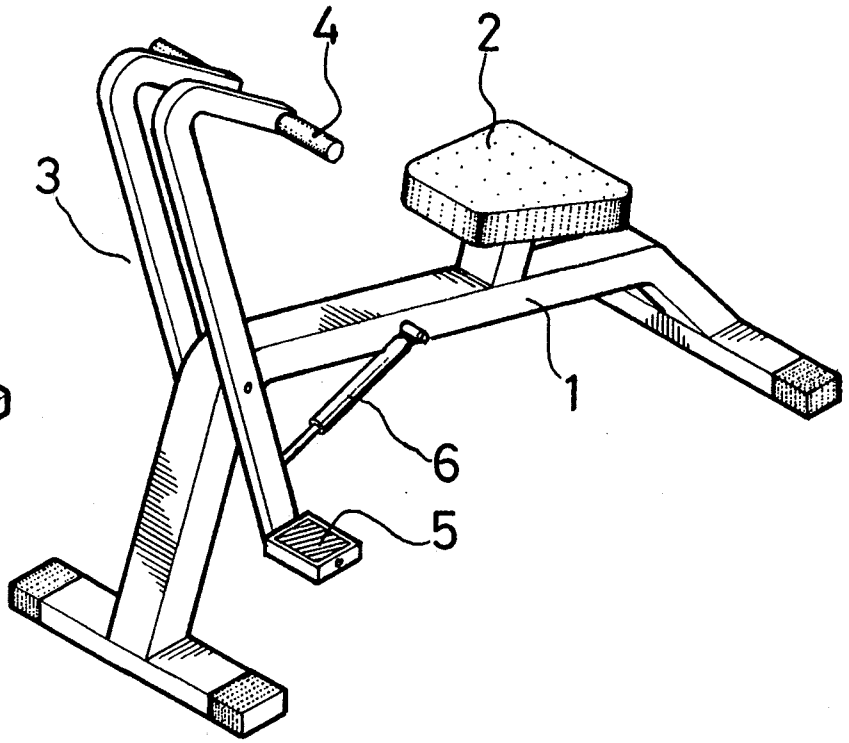
PRIOR ART FIG.1
FIG. 1 is an elevational view of a riding exerciser according to the prior art.
Figure 2:
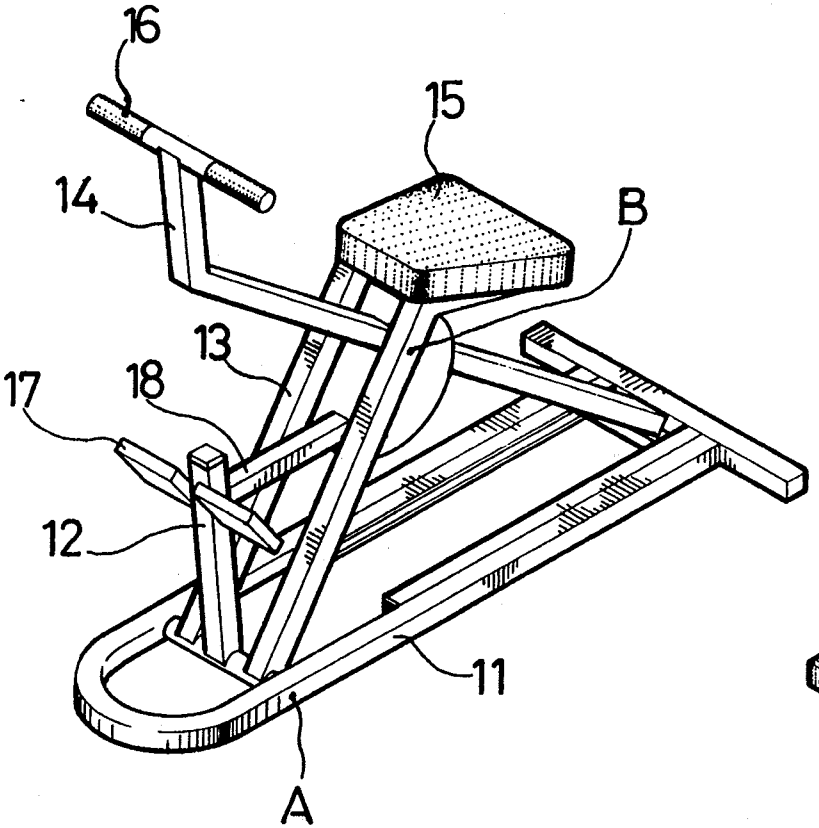
PRIOR ART FIG.2
FIG. 2 is an elevational view of another structure of riding exerciser according to the prior art.
Figure 3:
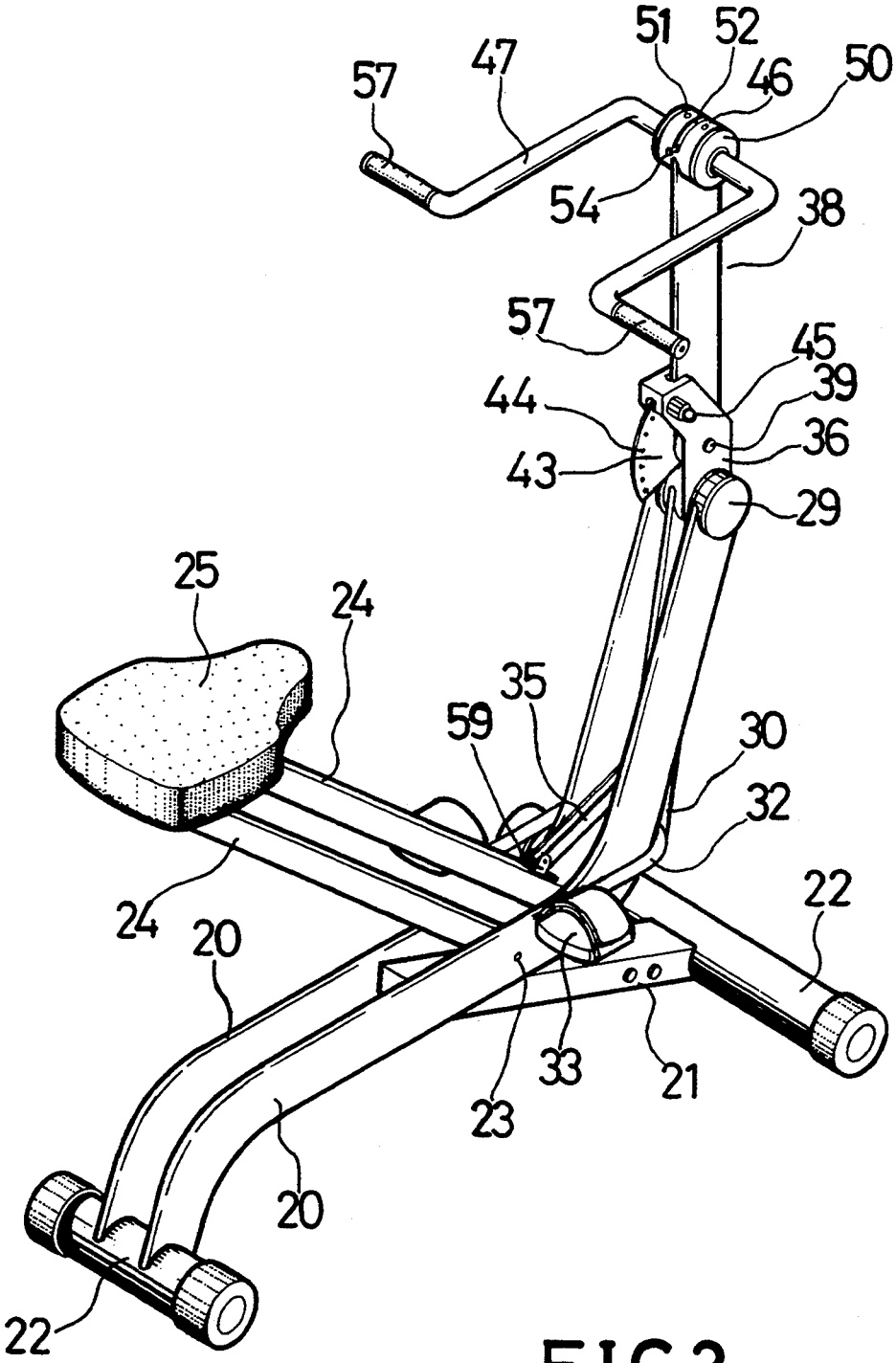
FIG. 3 is an elevational view of a riding exerciser according to the preferred embodiment of the present invention.

Referring to FIG. 3, two curved base frames 20 are joined by a bracket 21 and supported on two opposite cross bars 22. Two parallel seat supports 24 are symmetrically pivoted to either base frame 20 by a respective pivot 23 to hold a seat 25 at the top.

Figure 4:
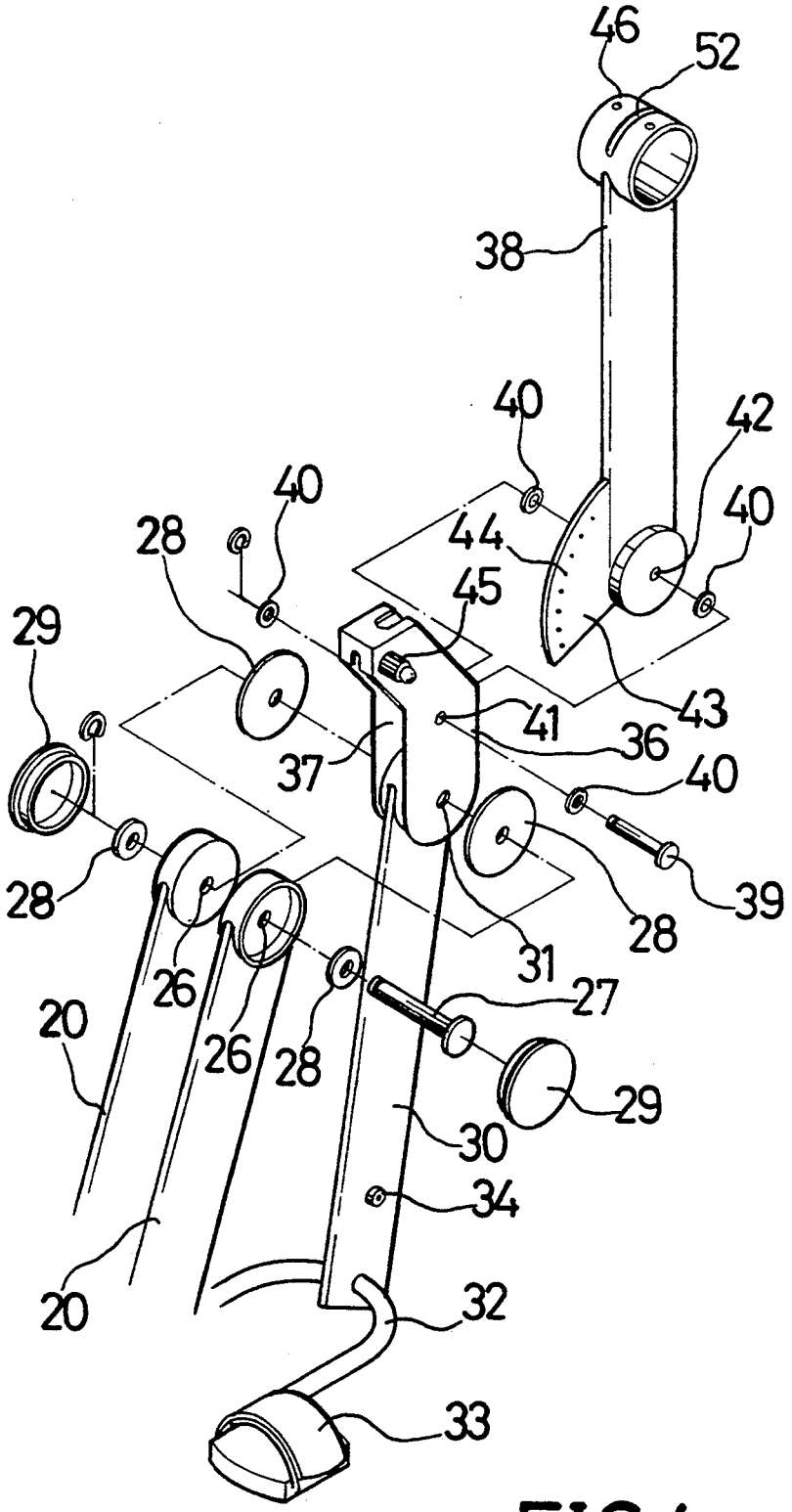
FIG. 4 is an exploded view of the riding exerciser shown in FIG. 3.

Referring to FIG. 4 and FIG. 3 again, there is a lower actuating rod 30 having a pivot hole 31 at a top end thereof pivotally connected between pivot holes 26 on the top ends of the curved base frames 20 by a pivot 27 and a plurality of washers 28 and two caps 29 . The bottom end of the lower actuating rod 30 is coupled with a U-tube 32 having two opposite ends spaced from the curved base frames 20 at two opposite sides and respectively connected with a respective pedal 33. The lower actuating rod 30 further has an axle hole 34 spaced above the U-tube 32 for fastening a link 35. The link 35 has an opposite end connected to the seat supports 24. The top end of the lower actuating rod 30 comprises a bridge plate 36 at the top defining a chamber 37 for receiving the bottom end of an upper actuating rod 38. The upper actuating rod 38 has a pivot hole 42 at the bottom connected between two opposite pivot holes 41 on the bridge plate 36 by a pivot 39 and a plurality of washers 40. A sector plate 43 is made on the bottom end of the upper actuating rod 38 and received in the chamber 37 of the bridge plate 36. The sector plate 43 has a series of lock holes 44 around the periphery for positioning. The bridge plate 36 further comprises a spring-supported lock bolt 45 inserted into either plug hole 44 on the sector plate 43 to fix the upper actuating rod 38 to the bridge plate 36 (the lower actuating rod 30) in any of a series of angular positions. By moving the spring-supported lock bolt 45 from one plug hole on the sector plate 43 to another, the angular position of the upper actuating rod 38 relative to the lower actuating rod 30 is adjusted.

Figure 5:
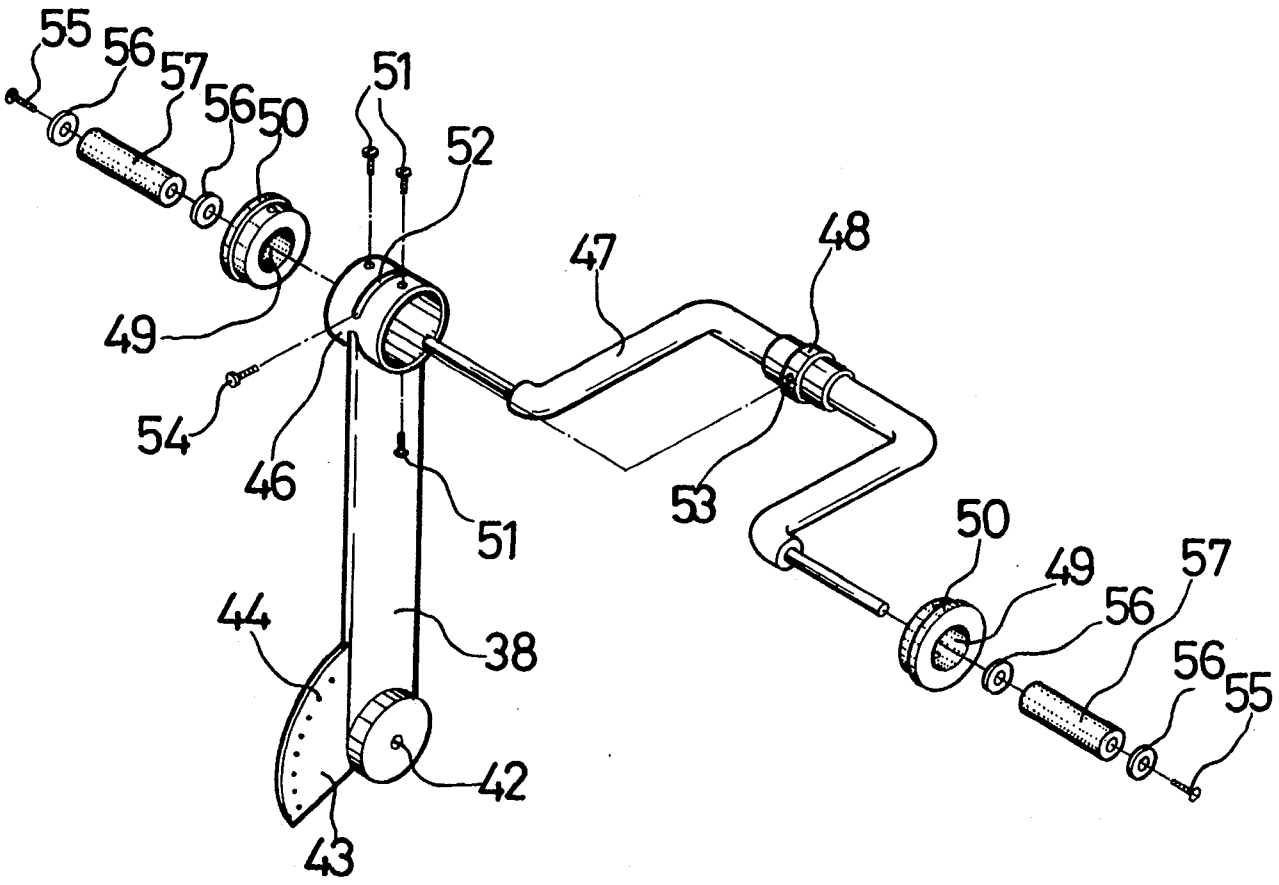
FIG. 5 is an exploded view of the handle, hand grips, and upper actuating rod of the riding exerciser shown in FIG. 3.

Referring to FIG. 5 and FIG. 3 again, the upper actuating rod 38 comprises a socket 46 horizontally disposed at the top to hold a curved handle 47. The curved handle 47 is inserted through the socket 46, having a flange 48 raised around the periphery in the middle and received inside the socket 46. Two stop rings 50 are respectively mounted around the curved handle 47 and fastened to the socket 46 at two opposite ends by tightening up screws 51 to stop the flange 48 inside the socket 46 so as to prohibit the handle 47 from being moved axially. The socket 46 has an elongated slot 52 disposed in the radial direction, through which a headed screw 54 is inserted and threaded into a screw hole 53 on the flange 48 to limit the rotating angle of the handle 47 relative to the socket 46. The two opposite ends of the handle 47 are respectively fastened with a respective hand grip 57 by screws 55 and washers 56.

Figure 6:
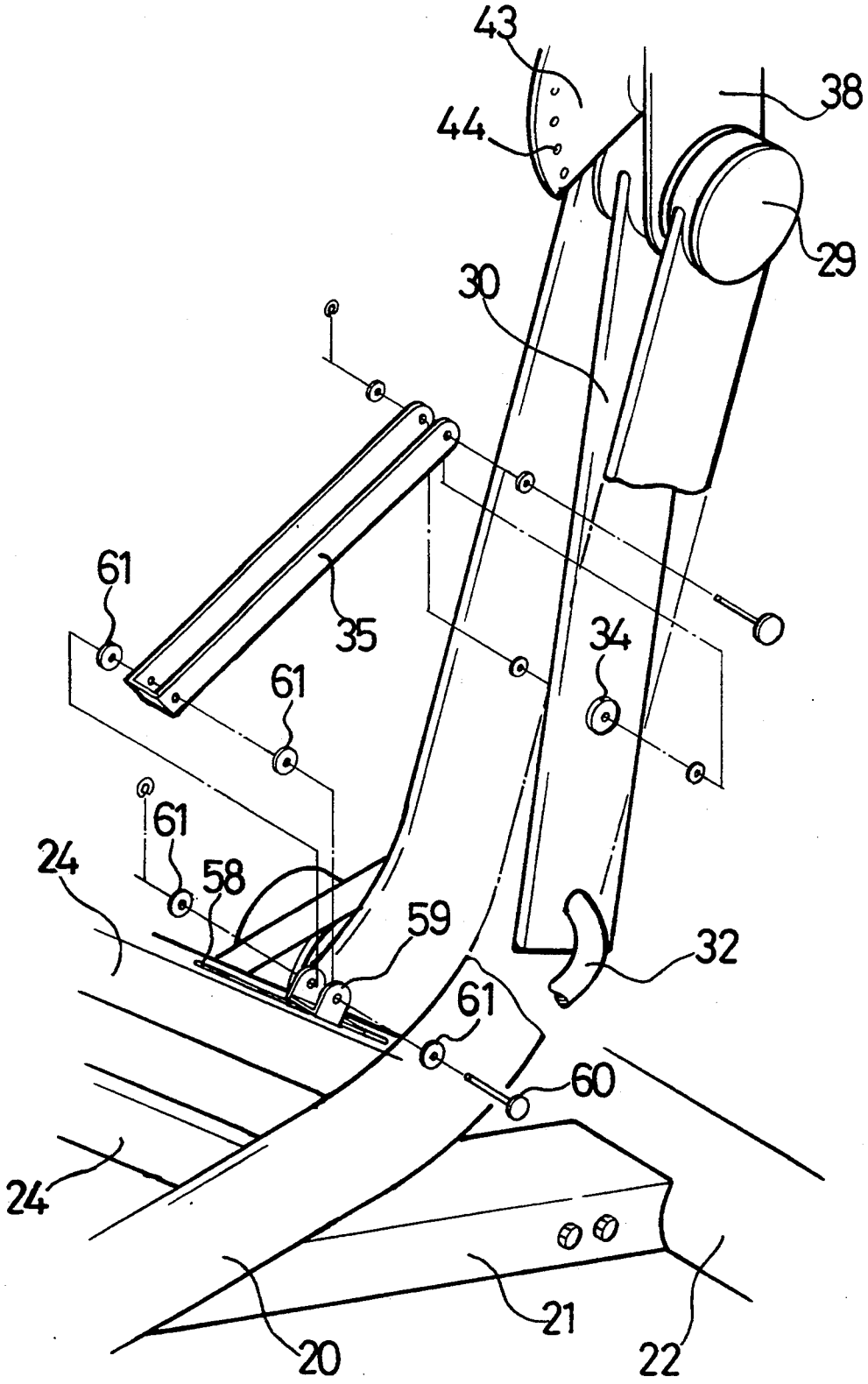
FIG. 6 is an exploded view of the link, seat supports, and lower actuating rod of the riding exerciser shown in FIG. 3.

Referring to FIG. 6 and FIG. 3 again, the link 35 has one end is connected to an adjusting slide 59 being made to slide in grooves 58 on the seat supports 24. The adjusting slide 59 can be fixed in a series of positions in the grooves 58, and therefore the elevation of the seat 25 can be adjusted as desired.

Figure 7:
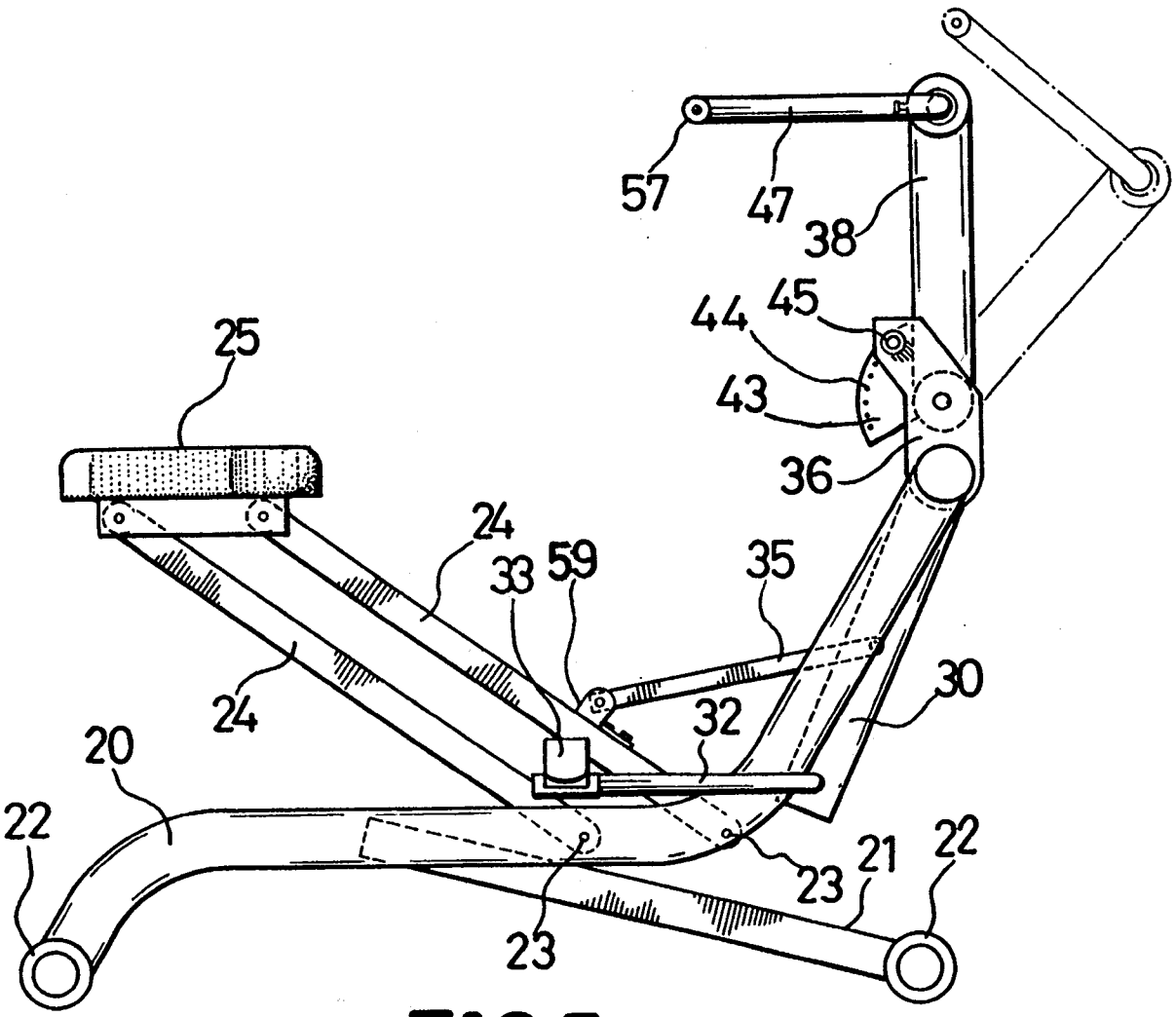
FIG. 7 is a side view of the riding exerciser shown in FIG. 3.
Figure 8:
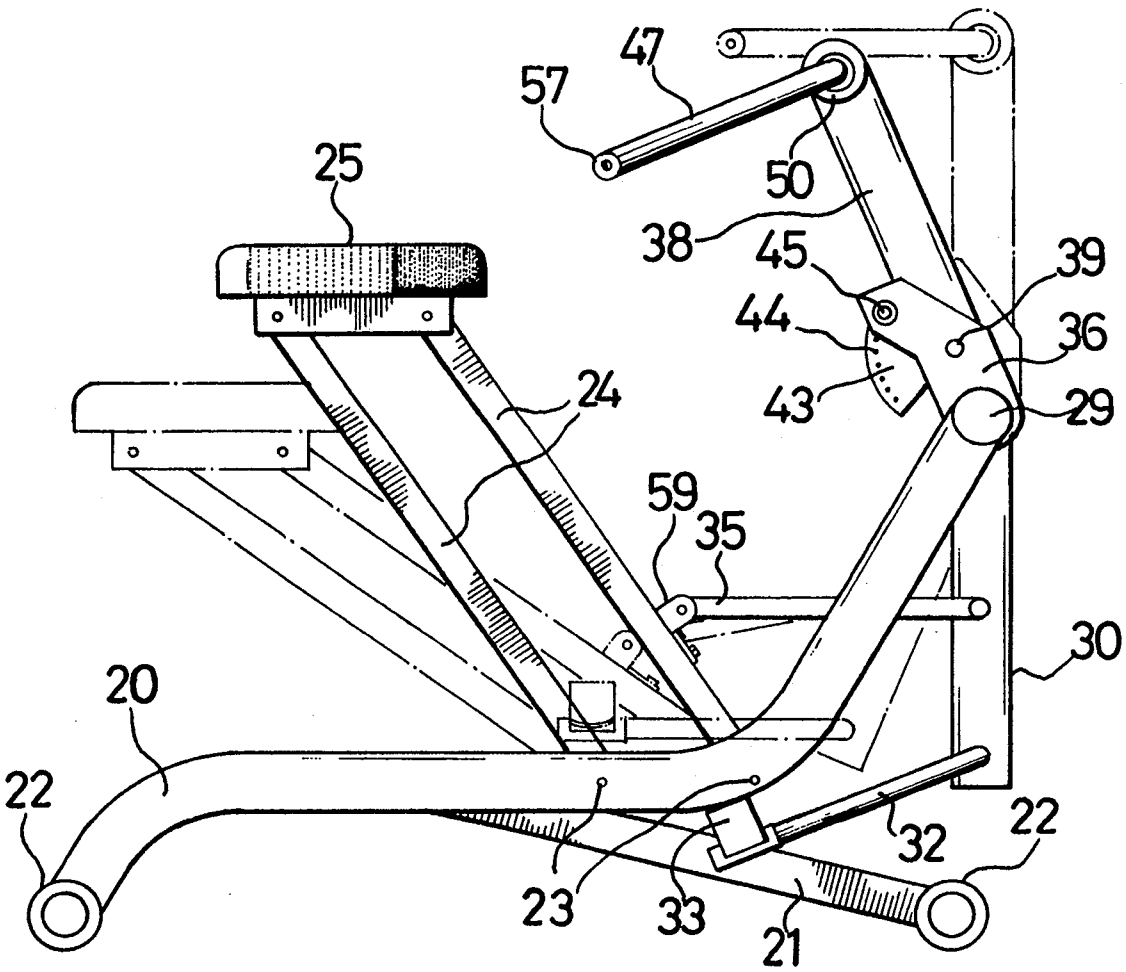
FIG. 8 shows the riding exerciser of FIG. 3 operated.

Referring to FIGS. 7 and 8, when in play, the player sits on the seat 25 with the hands holding the hand grips 57 and the legs stepped on the pedals 33. As the player extends out the legs to push the pedals 33 and pulls up the hand grips 57, the U-tube 32 is turned counterclockwise causing the link 35 moved forwards to pull the seat supports 24 from a sloping position to a vertical position. When released, the seat supports 24 and the hand grips 57 are returned to their former positions. Because the handle 47 is made curved, it does not touch the body of the user during the operation of the riding exerciser, and therefore the user does not feel uncomfortable.

Referring to FIG. 7 again, the angular position of the upper actuating rod 38 on the lower actuating rod 30 can be adjusted to change the distance between the hand grips 57 and the seat 25 so as to regulate the amount of exercise.

Referring to FIG. 8, the real lines show the pedals 33 pushed and the hand grips 57 pulled; the imaginary lines show the pedals 33 and the hand grips 57 released.

What is claimed is:

1. A riding exerciser comprising:

two curved base frames connected in parallel and having a respective pivot hole at the top aligned with each other;

two parallel seat supports pivoted to said curved base frames in the middle to support a seat, each seat support having a bottom end pivoted to either base frame in the middle by a pivot and a top end obliquely extended backwards and pivoted to said seat at either side;

a lower actuating rod having a top end pivotally connected between the pivot holes on said curved base frames at the top by a pivot and a bottom end fixed with a U-tube to hold a pair of pedals, said lower actuating rod comprising a bridge plate at the top, said bridge plate comprising a spring-supported lock bolt at one side;

an upper actuating rod having a bottom end pivotally connected to said bridge plate by a pivot and fixed with a sector plate having a series of lock holes around the periphery for locking by said spring-supported lock bolt, and a top end fixed with a horizontal socket;

a curved handle inserted through said horizontal socket and retained in place by stop rings being fastened to said horizontal socket at two opposite ends; and a link having one end pivotally connected to said lower actuating rod by a pivot at an elevation above said U-tube, and an opposite end pivotally connected to a slide being adjustably fixed to said seat supports.

2. The riding exerciser of claim 1 wherein said handle comprises a flange raised around the periphery in the middle and having a screw hole; said horizontal socket has an elongated slot disposed in the radial direction, through which a headed screw is inserted and threaded into the screw hole on the flange of said handle to limit the rotating angle of said handle relative to said horizontal socket.

* * * * *